US012134887B2

(12) United States Patent
Hansort

(10) Patent No.: US 12,134,887 B2
(45) **Date of Patent: *Nov. 5, 2024**

(54) GROUND ANCHOR BRACKET WITH SIMULATED SLAB SUPPORT FOR CONCRETE WALL BRACES

(71) Applicant: CCS Contractor Equipment &Supply, LLC, Naperville, IL (US)

(72) Inventor: Marinus Hansort, St. Pete Beach, FL (US)

(73) Assignee: CCS Contractor Equipment &SupplyLLC, Naperville, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/377,709

(22) Filed: Jul. 16, 2021

(65) Prior Publication Data

US 2021/0340751 A1 Nov. 4, 2021

Related U.S. Application Data

(62) Division of application No. 16/365,202, filed on Mar. 26, 2019, now Pat. No. 11,066,824.

(60) Provisional application No. 62/648,611, filed on Mar. 27, 2018.

(51) Int. Cl.

| | |
|---|---|
| ***E02D 5/76*** | (2006.01) |
| ***E04B 1/18*** | (2006.01) |
| ***E04C 5/16*** | (2006.01) |
| ***E04G 21/26*** | (2006.01) |
| *E02D 5/80* | (2006.01) |
| *E04C 3/02* | (2006.01) |
| *E04H 12/20* | (2006.01) |

(52) U.S. Cl.

CPC ..... *E04B 1/185* (2013.01); *E04C 5/16* (2013.01); *E02D 5/76* (2013.01); *E02D 5/80* (2013.01); *E04C 2003/026* (2013.01); *E04G 21/26* (2013.01); *E04H 12/20* (2013.01)

(58) Field of Classification Search

CPC ..... E04G 21/26; E04G 17/14; E04B 1/185; E04C 5/16; E04C 2003/026; E04H 12/20; E02D 5/76; E02D 5/74; E02D 5/80

See application file for complete search history.

(56) References Cited

U.S. PATENT DOCUMENTS

| | | | |
|---|---|---|---|
| 2,511,584 | A | 6/1950 | Hill |
| 2,687,268 | A | 8/1954 | Hawes |
| 2,777,660 | A | 1/1957 | Albrecht |

(Continued)

FOREIGN PATENT DOCUMENTS

| | | | |
|---|---|---|---|
| DE | 29919707 | U1 | 2/2000 |

*Primary Examiner* — Phi D A

(74) *Attorney, Agent, or Firm* — Bodman PLC

(57) ABSTRACT

A ground anchor bracket for supporting at least one wall brace at an earth anchor includes a sleeve that has a wall structure surrounding a hollow interior that is configured to receive a stem of the earth anchor. A platform is coupled with an upper portion of the sleeve and has an upper surface that is configured to support a shoe of a wall brace. A post is coupled with the platform and the post protrudes upward from the upper surface of the platform so as to be configured to engage a slot in the shoe of the wall brace. The upper surface of the platform may be substantially planar to simulate a slab floor surface for engaging the shoe of the wall brace.

20 Claims, 9 Drawing Sheets

(56) References Cited

U.S. PATENT DOCUMENTS 2,832,559 A * 4/1958 Hillberg ..... E04G 21/26 254/98
2,945,662 A 7/1960 Jennings
3,006,592 A 10/1961 Davis, Jr.
3,154,833 A 11/1964 Kimball
3,171,627 A 3/1965 Tapley et al.
3,371,902 A 3/1968 Hartwick
3,504,880 A 4/1970 Toms
3,728,838 A 4/1973 Stout
3,750,349 A 8/1973 Deilke
3,788,026 A 1/1974 Cook
3,817,006 A * 6/1974 Williams ..... E04G 21/26 248/354.3
3,874,625 A * 4/1975 Hansen ..... E04G 21/26 52/703
3,908,956 A 9/1975 Gates
4,000,592 A 1/1977 Kelly
4,068,427 A * 1/1978 Camardo ..... E04G 21/26 52/749.1
4,070,833 A 1/1978 Hancock
4,083,156 A 4/1978 Tye
4,148,162 A * 4/1979 Goodrich ..... E04B 1/34336 280/764.1
4,223,492 A 9/1980 St. Clair
4,872,634 A * 10/1989 Gillaspy ..... E04G 21/26 248/354.3
4,880,203 A 11/1989 Holcomb et al.
4,944,123 A 7/1990 Larrieu
5,171,107 A * 12/1992 Hamilton ..... E02D 27/48 405/230
5,213,448 A * 5/1993 Seider ..... E02D 27/48 405/230
5,246,311 A * 9/1993 West ..... E02D 35/00 405/230
5,524,854 A 6/1996 McSwain
5,862,635 A 1/1999 Linse et al.
6,263,622 B1 * 7/2001 Griffin ..... E02D 5/801 52/156
6,298,611 B1 * 10/2001 Oliver ..... E02D 5/801 52/157
6,347,489 B1 2/2002 Marshall, Jr. et al.
6,505,447 B1 1/2003 Oliver et al.
6,854,222 B2 2/2005 Hansort
6,871,455 B1 3/2005 Cockman et al.
6,872,031 B2 * 3/2005 May ..... E02D 35/00 405/232
6,971,209 B1 12/2005 Blevins
6,986,495 B2 1/2006 Pinkleton et al.
7,195,426 B2 * 3/2007 May ..... E02D 27/12 405/230
7,416,367 B2 * 8/2008 St. Onge ..... E02D 5/80 405/230
8,919,060 B1 12/2014 Oliver et al.
9,206,580 B2 12/2015 Oliver et al.
9,365,998 B2 * 6/2016 Perko ..... E02D 5/22
9,394,717 B2 7/2016 Paananen
9,556,581 B2 1/2017 Hale
9,631,392 B2 4/2017 Bergman
9,932,718 B2 4/2018 Blevins
10,006,185 B2 6/2018 Tomchesson et al.
11,149,398 B2 * 10/2021 Boucher ..... E04G 23/065
11,268,253 B2 * 3/2022 Trebil ..... E02D 5/223
11,299,863 B2 * 4/2022 Reusing ..... E02D 5/223
2001/0000842 A1 5/2001 MacKarvich
2002/0170253 A1 11/2002 MacKarvich
2003/0190196 A1 10/2003 Lanka
2005/0188627 A1 * 9/2005 Alberts ..... E02D 5/801 52/166
2006/0096184 A1 5/2006 Kraaiijkamp
2006/0179728 A1 8/2006 Lang
2007/0028533 A1 * 2/2007 Stroyer ..... E01D 15/133 52/489.1
2009/0199466 A1 8/2009 Rosaen
2011/0036026 A1 2/2011 Lee
2011/0047895 A1 3/2011 Finch
2012/0031017 A1 2/2012 Stroyer
2012/0255242 A1 10/2012 Patton
2012/0304555 A1 12/2012 Oliver et al.
2014/0356076 A1 12/2014 Hale et al.
2014/0366463 A1 12/2014 Oliver et al.
2015/0247336 A1 9/2015 Bergman
2016/0215519 A1 7/2016 Bergman
2017/0226713 A1 8/2017 Blevins et al.
2018/0058082 A1 3/2018 Hansort

* cited by examiner

GROUND ANCHOR BRACKET WITH SIMULATED SLAB SUPPORT FOR CONCRETE WALL BRACES

CROSS REFERENCE TO RELATED APPLICATIONS

This application is a Divisional Application of U.S. non-provisional application Ser. No. 16/365,202, filed Mar. 26, 2019, which claims benefit and priority under 35 U.S.C. § 119(e) to U.S. provisional application Ser. No. 62/648,611, filed Mar. 27, 2018, the disclosure of which is hereby incorporated by reference in its entirety.

TECHNICAL FIELD

This disclosure relates generally to wall braces used to support upright wall panels and forms, such as tilt-up panels, and more particularly relates to ground anchors for such braces.

BACKGROUND

It is generally known to temporarily brace precast concrete structures, such as wall panels or forms or the like, in an upright or vertical orientation with tilt-up wall braces that extend at an angle from the floor or ground to an elevated portion of the wall. For example, prefabricated concrete wall panels may be formed on a flat surface and subsequently lifted or tilted up to an upright or vertical orientation. Tilt-up wall braces commonly include heavy steel poles and/or adjustable length pipe sections that engage the wall panels and may be secured to the floor or ground generally remain in place until additional structural components are secured to the wall, such as a roof structure being installed over the supported or braced walls, thus providing sufficient stability to the building structure to allow the braces to be safely removed.

SUMMARY

The present disclosure provides a ground anchor assembly that uses an anchor bracket to support at least one wall brace at an earth anchor, such as a helical anchor engaged in soil or gravel or the like. The anchor bracket has a base structure that is configured to attach to an end of the earth anchor and may be provided as a sleeve, such as tubular structure, that has a wall surrounding a hollow interior area that receives a stem or outermost portion of the earth anchor. One or more platforms may be attached to or supported at an upper portion of the sleeve, where the platform may have an upper surface configured to support a lower end of a wall brace, such as a shoe disposed at the lower end of the wall brace. A retention member, such as a post, may protrude upward from the upper surface of the platform to engage the lower end of the wall brace, such as a slot in the shoe. The upper surface of the platform may be substantially planar to simulate a slab floor surface for engaging the shoe of the wall brace, such that the lower end of the wall braces may be quickly and efficiently engaged to the ground anchors at the brackets without modification to the shoes or wall braces.

According to one aspect of the present disclosure, a ground anchor bracket for supporting at least one wall brace at an earth anchor includes a sleeve that has a wall structure surrounding a hollow interior that is configured to receive a stem of the earth anchor. A platform is coupled with an upper portion of the sleeve and has an upper surface that is configured to support a shoe of a wall brace. A post is coupled with the platform and the post protrudes upward from the upper surface of the platform so as to be configured to engage a slot in the shoe of the wall brace. The upper surface of the platform may be substantially planar to simulate a slab floor surface for engaging the shoe of the wall brace.

According to another aspect of the present disclosure, a ground anchor bracket for supporting two wall braces at an earth anchor includes a sleeve that is configured to receive a stem of the earth anchor. A pair of platforms may be coupled with an upper portion of the sleeve, where each platform has an upper surface that is configured to support a shoe of one of the wall braces. A retention member may be coupled with each of the pair of platforms that protrudes upward from the upper surface of the respective platform for engaging the shoe of the respective wall brace supported at the upper surface of the platform. The upper surfaces of the platforms may be substantially planar and disposed at an offset angle from each other to angle the supported braces away from each other.

These and other objects, advantages, purposes, and features of the present disclosure will become apparent upon review of the following specification in conjunction with the drawings.

DETAILED DESCRIPTION

Figure 1:
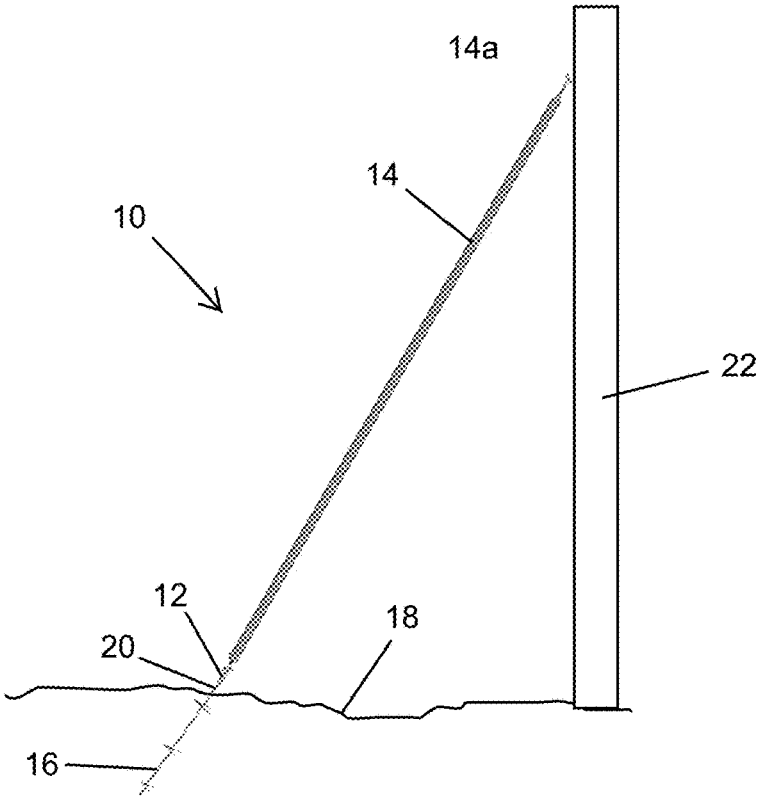
FIG. 1 is a side elevation view of an upright wall panel supported by a wall brace connected to a ground anchor assembly in accordance with the present disclosure.

Referring now to the drawings and the illustrative embodiments depicted therein, a ground anchor assembly 10 may include a ground anchor bracket 12 to support at least one wall brace 14 at a ground anchor, such as a helical anchor 16 that is engaged in soil or gravel or the like. The helical anchor 16 may be driven into the ground 18, such as via rotation, to leave a stem portion 20 of the helical anchor 16 exposed above the ground 18, such as shown in FIG. 1. The stem portion 20 may then be engaged by a ground anchor bracket 12 to provide stable support to a wall brace 14. The ground anchor bracket 12 may be configured to support the wall brace 14 at an angle that extends upward from the helical anchor 16 to brace against an upright structure, such as a wall panel 22 or structure or the like. The wall panel 22 may be formed at least partially with concrete, such as a tilt-up concrete panel or a precast concrete panel or similar wall panel structure. The wall brace 14 functions to maintain the upright or vertical orientation of the wall panel 22 or structure, such as when undergoing forces, such as from wind or other forces expected during a construction operation. Thus, the connection provided by the ground anchor bracket 12 between the wall brace 14 and the helical anchor 16 ensures stable and reliable bracing at ground-based connection points.

Figure 2:
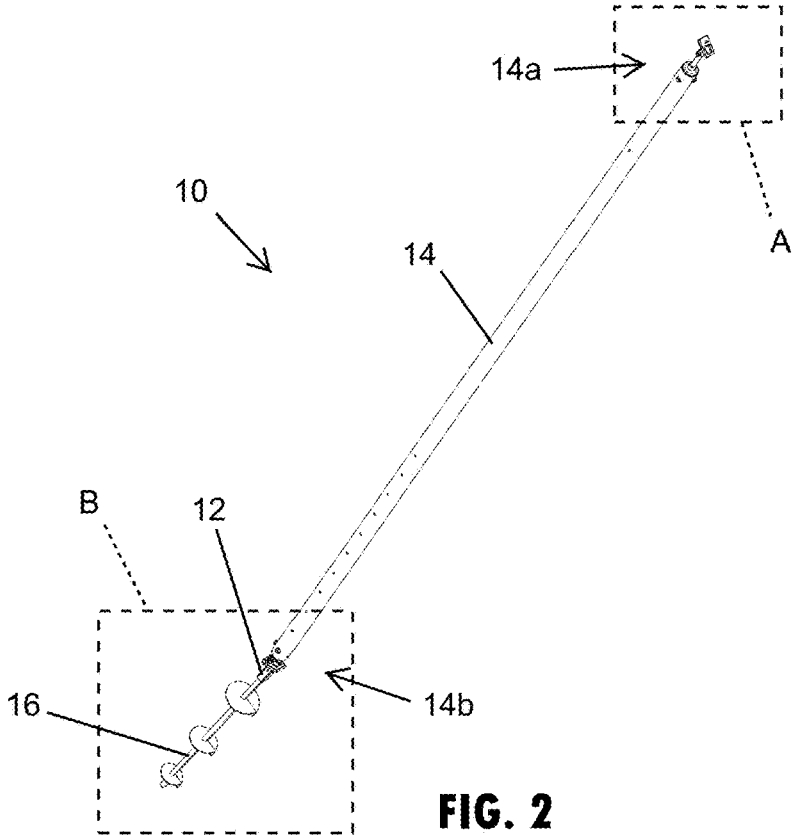
FIG. 2 is a perspective view of the wall brace and attached ground anchor assembly shown in FIG. 1.
Figure 2A:
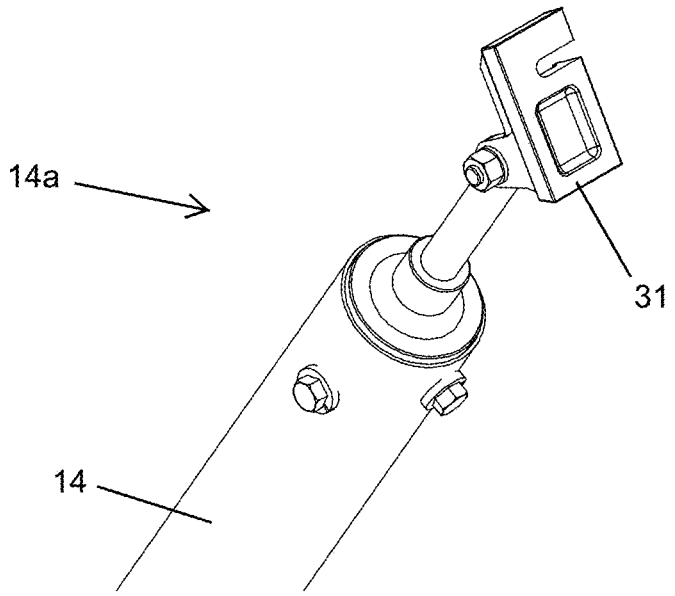
FIG. 2A is an enlarged perspective view of a section of an upper portion the wall brace and a wall connector shown in section A of FIG. 2.
Figure 2B:
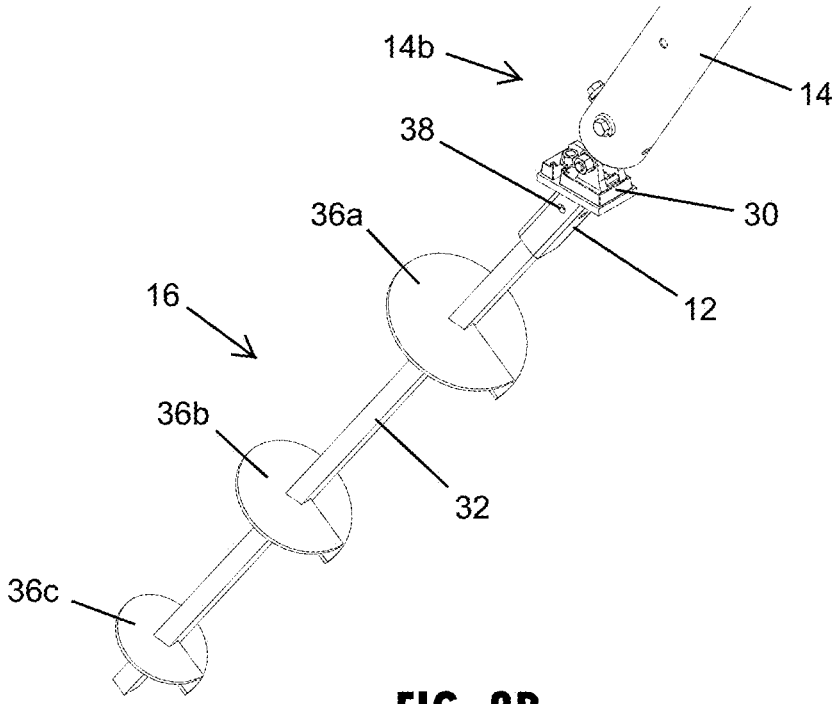
FIG. 2B is an enlarged perspective view of a section of a lower portion the wall brace attached at a ground anchor assembly with a bracket shown in section B of FIG. 2.

The ground anchor bracket 12 has a base structure that attaches to the end of the earth anchor 16 once it is anchored into the ground. The base structure of the anchor bracket 12 may include a sleeve 24 that has a wall structure surrounding a hollow interior area 26 that receives the stem 20 or outermost portion of the helical anchor 16, such as shown in FIG. 2B. Accordingly, the stem 20 of the earth anchor 16 may have a cross-sectional shape that is generally orthogonal, such as a square or rectangular shape, which may be generally continuous along the length of the stem 20. The sleeve 24 of the anchor bracket 12 may engage around the stem 20, whereby the wall structure of the sleeve 24 has a cross-sectional shape that corresponds with the cross-sectional shape of the stem 20, so as to mate the interior surface of the sleeve 24 against the exterior surface of the end of the stem 20. The mated engagement of the orthogonally shaped sleeve 24 with the stem 20 prevents the sleeve 24 from rotating relative to the stem 20.

Figure 3:
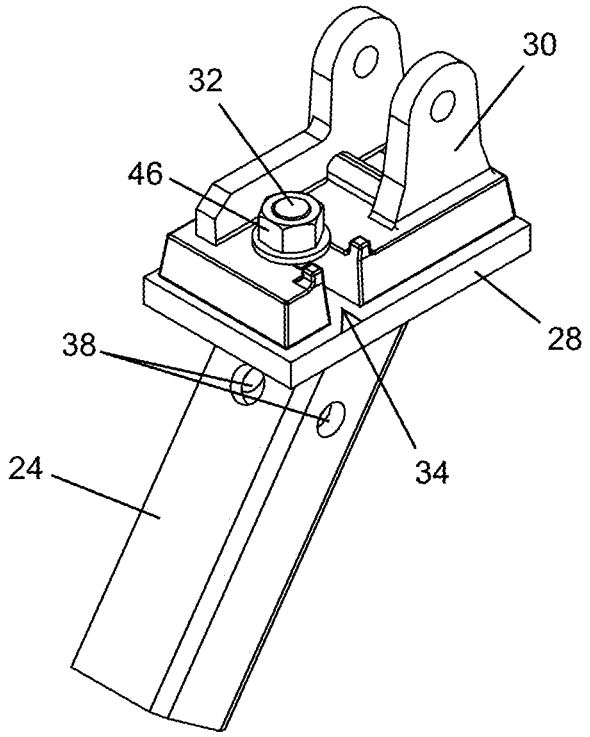
FIG. 3 is a perspective view of the ground anchor bracket shown in FIG. 2B, showing a connection shoe of the brace attached to the bracket.
Figure 4:
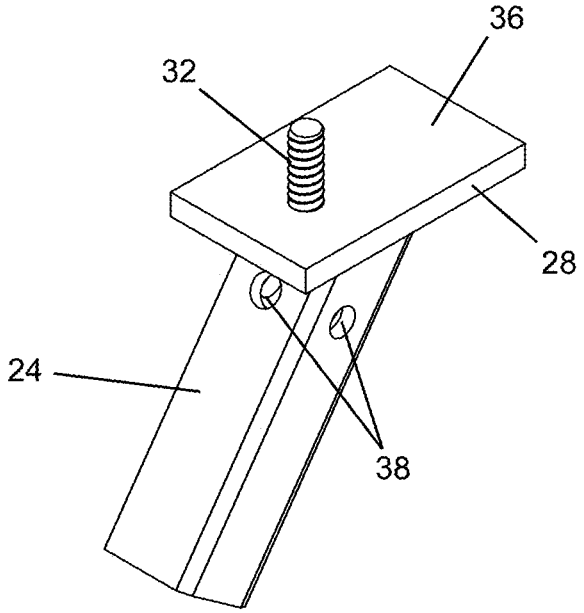
FIG. 4 is a perspective view of the ground anchor bracket shown in FIG. 3 without the connection shoe attached.
Figure 5:
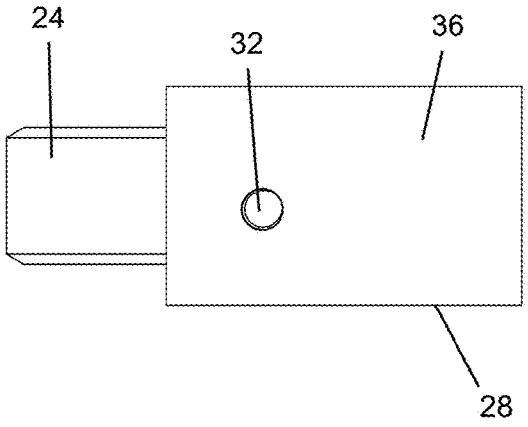
FIG. 5 is a top plan view of the ground anchor bracket shown in FIG. 4.
Figure 6:
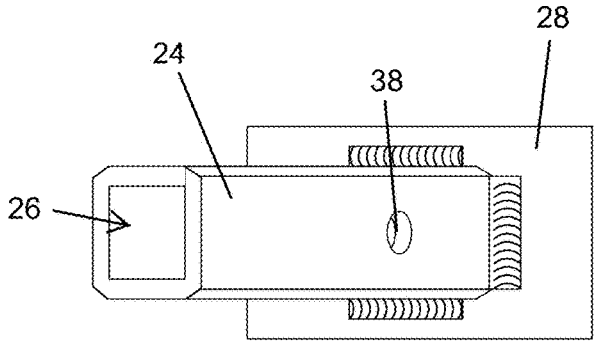
FIG. 6 is a bottom plan view of the ground anchor bracket shown in FIG. 4.

One or more platforms 28 may be attached to or supported at an upper portion of the sleeve 24 for supporting a lower end 14*b* of the wall brace 14. As shown in FIG. 3, the platform may be configured to easily attach and support a shoe 30 that is disposed at the lower end 14*b* of the wall brace 14. A retention member may be provided at the ground anchor bracket 12 to engage the shoe 30 of the wall brace 14. The retention member may include a coil or post 32 that protrudes upward from the platform 28 to engage a slot 34 (FIG. 3) in the shoe 30. Also, an upper surface 36 (FIG. 4) of the platform 28 may be configured to support the underside of the shoe 30 and may be substantially planar to simulate a slab floor surface for engaging a bottom surface of the shoe 30 at the lower end 14*b* of the wall brace 14. In doing so, the shoe at the lower end of the wall brace that is typically used to support the lower end of the wall brace at a slab surface, such as slab floor, may be quickly and efficiently engaged to the ground anchor at the ground anchor brackets 12 without modification or removal of the shoe.

With reference to FIG. 1, the wall brace 14 may extend at an angle from the ground 18 to an elevated portion of the wall panel 22 to temporarily support the wall panel 22 in a desired upright or vertical position, such as during construction of an associated building or structure or the like. The wall brace 14 may extend generally linearly between its upper and lower ends 14*a*, 14*b* to provide direct supportive load paths. The wall brace 14 may include a single metal pole or pipe or multiple engaged metal poles or pipes, such as adjustable length pipe sections that use removable shear pins to adjust the brace to the desired length. As shown in FIG. 2, the wall brace 14 is provided as a length adjustable pipe section. The upper end 14*a* of the wall brace 14 may be attached at or temporarily fixed to the wall panel 22, such as with fasteners, anchors, or the like to secure the upper end 14*a* of the wall brace 14 before or after lifting and positioning the wall panels and before or after securing or attaching the lower end 14*b* of the wall brace 14 to the floor or ground anchor assembly 10. As shown in FIG. 2A, the upper end 14*a* of the wall brace 14 may also include a shoe 31, such as the same or similar configuration to the shoe 30 (FIG. 3) at the lower end 14*b* of the wall brace 14.

Before securing or engaging the lower end 14*b* of the wall brace 14 to the ground anchor assembly 10, the ground anchor, such as the helical anchor 16 shown in FIG. 3, may have a lower portion that is driven into or otherwise anchored into the earth or ground. The lower portion of the anchor 16 may include an elongated shank 32, such as shown in FIG. 2B, which may be surrounded by a helical threaded portion 34, such as a spiral or auger shaped member that helically extends around at least a portion of the shank 32. The helical anchor 16, as further shown in FIG. 2B, may have separate sections 36*a*, 36*b*, 36*c* of the helical threaded portion 34 spaced along the elongated shank 32. It is contemplated that each section of the helical threaded portion may be configured differently from the illustrated embodiments, such as with different thread angles, to engage at various depths of ground, such as ground that has different soil compressions and/or types. It is also understood that the helical threaded portion may be formed continuously along the shank portion and/or formed in various shapes or thread patterns from the illustrated embodiments to securely engage the ground and prevent withdrawal from the ground, such as due to forces acting on the wall panel.

Figure 7:
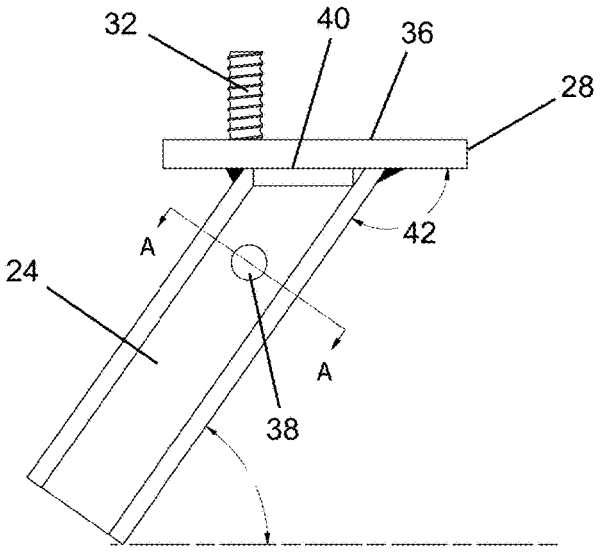
FIG. 7 is a side elevation view of the ground anchor bracket shown in FIG. 4.
Figure 8:
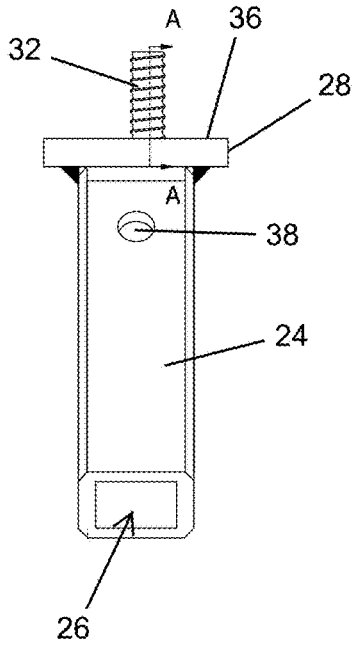
FIG. 8 is another side elevation view of the ground anchor bracket shown in FIG. 4.

The ground anchor bracket 12 may attach to the upper portion or stem portion of the helical anchor 16 by engaging the sleeve 24 over the stem portion, such that the stem portion extends into the hollow interior area 26 of the sleeve 24, such as shown in FIG. 2B. The ground anchor bracket 12 may have a wall structure with a generally consistent wall thickness disposed around the hollow interior area 26 of the sleeve 24 that may be disposed generally centrally through the sleeve 24, such as to provide a tubular shape. It is also contemplated that the wall structure of the sleeve may be formed with multiple pieces, such as shown in FIG. 7B, where four individual plates are welded at corners 25*a* to form a sleeve 24*a* that surrounds a hollow interior area 26*a* for engaging the anchor stem.

Figure 7A:
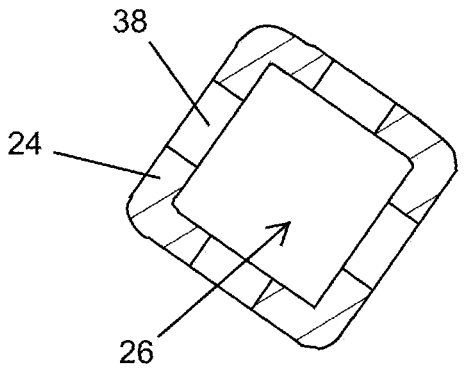
FIG. 7A is a cross-sectional view of the ground anchor bracket, taken at line A-A shown in FIG. 7.
Figure 7B:
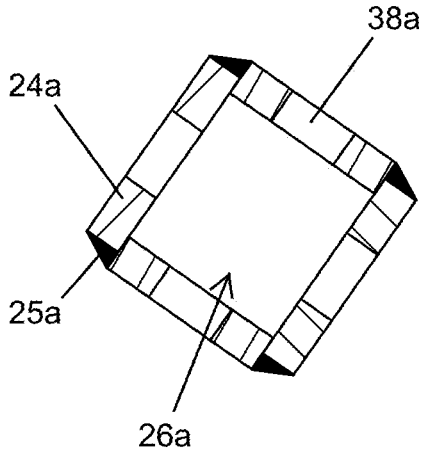
FIG. 7B is a cross-sectional view of an additional embodiment of a ground anchor bracket, showing four plates welded at corners to form a sleeve for engaging the anchor stem.

Also, the sleeve 24 may have a non-circular cross sectional shape to prevent rotation of the sleeve 24 on the helical anchor 16, such as a polygonal shaped or orthogonally shaped or a substantially rectangular or square shaped cross-section, as shown in FIG. 7A. The wall structure of the sleeve 24 may be shaped to correspond with the shape of the upper portion of the elongated shank of the helical anchor 16 for matably attaching or engaging the sleeve 24 to the helical anchor 16. Thus, as shown in FIG. 2B, the sleeve 24 may have a generally square cross-sectional shape to corresponds with the generally square cross-sectional shape of the upper portion of the helical anchor 16. It is understood that various mated cross-sectional shapes may be provided at the interface of the ground anchor bracket and the ground anchor in additional embodiments.

To secure the sleeve 24 to the helical anchor 16, the ground anchor bracket 12 may have openings 38 in sides of the wall structure of the sleeve 24 that may align with each other through the sleeve 24. These openings 38 may be aligned with openings in the upper portion of the helical anchor 16, such that the aligned openings may receive a fastener, such as a cotter pin or lock pin or bolt or the like, that is disposed through the helical anchor 16 and the openings 38, such to provide a secure connection between the ground anchor bracket 12 and the anchor 16. It is also contemplated that the ground anchor bracket 12 may be integrally formed with the earth anchor 16, such that the platforms 28 and retention members for engaging and supporting the shoe or shoes of the wall brace or braces, may be formed or attached directly to the stem of the earth anchor.

The platform 28 attached to or supported at an upper portion of the sleeve 24, such as shown in FIGS. 1 and 7, may be positioned to horizontally orient or otherwise generally align the upper surface 36 of the platform 28 with a planar extent of the ground surface 18. As also shown in FIG. 7, the upper surface 36 of the platform 28 may be substantially planar to simulate a slab floor surface for engaging the shoe 30 of the wall brace 14. The upper portion of the wall structure of the sleeve 24, as shown in FIG. 7, may include an upper edge 40 that is disposed around the sleeve 24 in a plane that is oriented at an offset angle 42 from the linear extent of the sleeve 24 or a central axis surrounded by the wall structure of the sleeve 24. The offset angle 42 of the plane disposed at the upper edge of the sleeve may be at or between 110° and 135° or between 115° and 130° or approximately 125°. As shown in FIGS. 1-8, the upper edge 40 may attached at a lower surface of the platform 28. Thus the offset angle 42 may be configured to horizontally orient the upper surface 36 of the platform 28 when the elongated shank 32 of the ground anchor 16 is angled at approximately 55° when engaged in the ground. This angle of the ground anchor may vary by at least 20° but it is contemplated that the wall brace 14 is substantially aligned with the angle of the ground anchor 16 to efficiently hold and brace under load conditions.

Figure 8A:
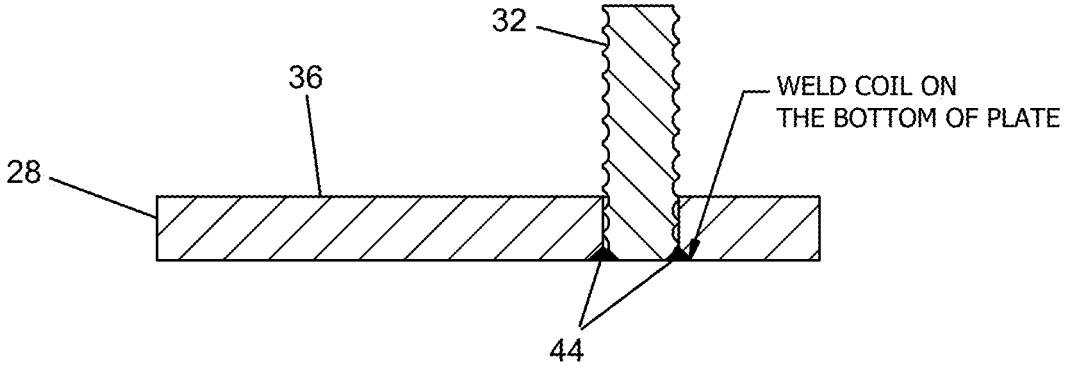
FIG. 8A is a cross-sectional view of the ground anchor bracket, taken at line A-A shown in FIG. 8.
Figure 9:
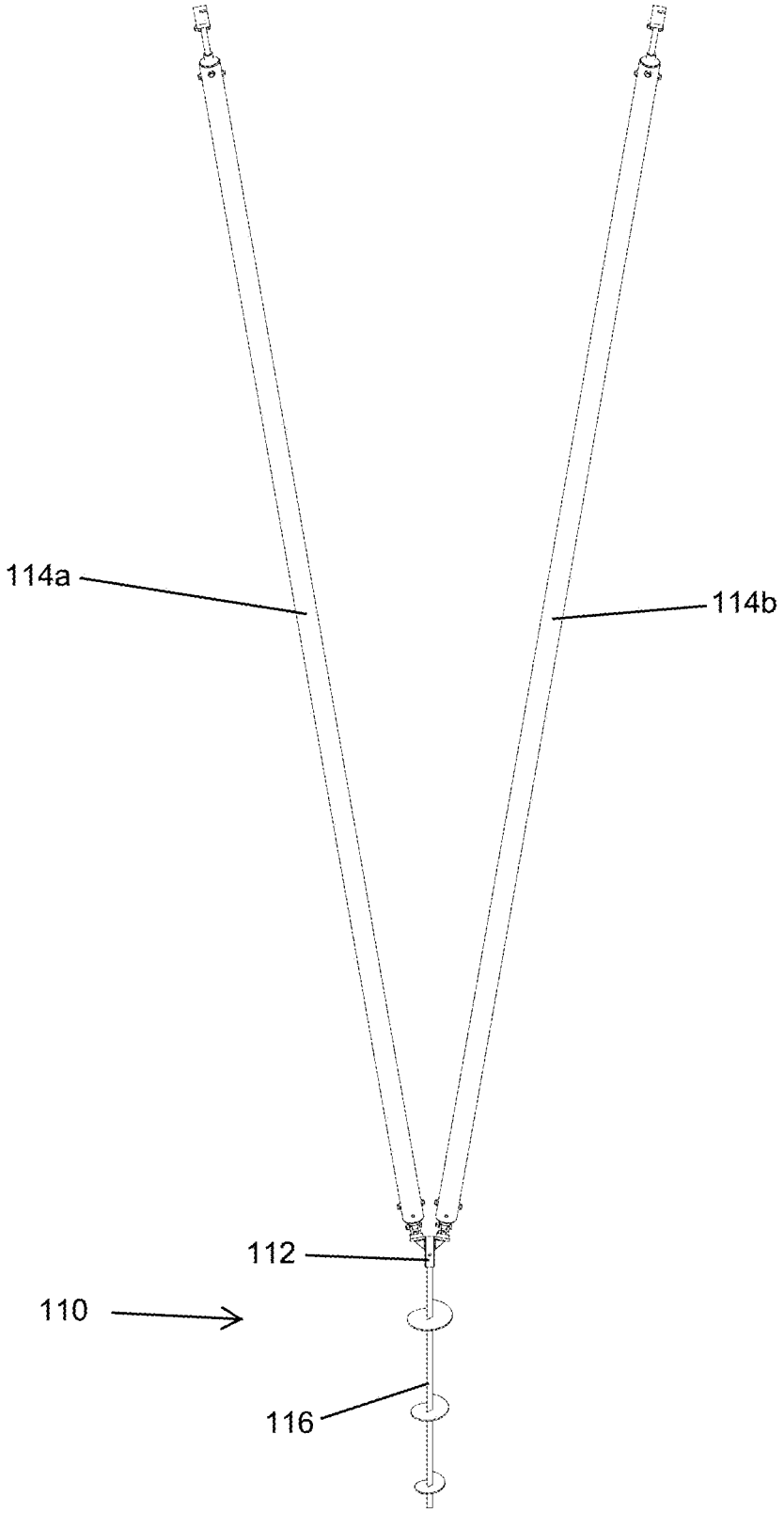
FIG. 9 is a side elevation view of two wall braces connected to an additional embodiment of a ground anchor assembly in accordance with the present disclosure.

With the bottom surface of the shoe 30 engaged with and/or supported at the upper surface 36 of the platform 28, the shoe 30 may be further supported with a retention member, such as a coil or post 32. The post 32 shown in FIGS. 7 and 8 protrudes upward from the platform 28 upright and substantially orthogonal to the planar extent of the upper surface 36 of the platform 28. To hold the coil or post 32 at the platform, the coil or post 32 may be inserted within a vertical opening in the platform 28 and a connection 44 may be formed between the platform 28 and the post 32, such as with welding as shown in FIG. 8A or other connections, such as threadably attaching or adhesive or the like. The coil or post 32 may be disposed on the platform 28 in a location that engages the slot 34 in the shoe 30, such as shown in FIG. 3. Further, the post may 32 have a threaded outer surface that is configured to threadably engage a nut 46 that clamps of the shoe 30 at the lower end 14*b* of the wall brace 14 against the upper surface 36 of the platform 28, as shown in FIG. 3.

Figure 13:
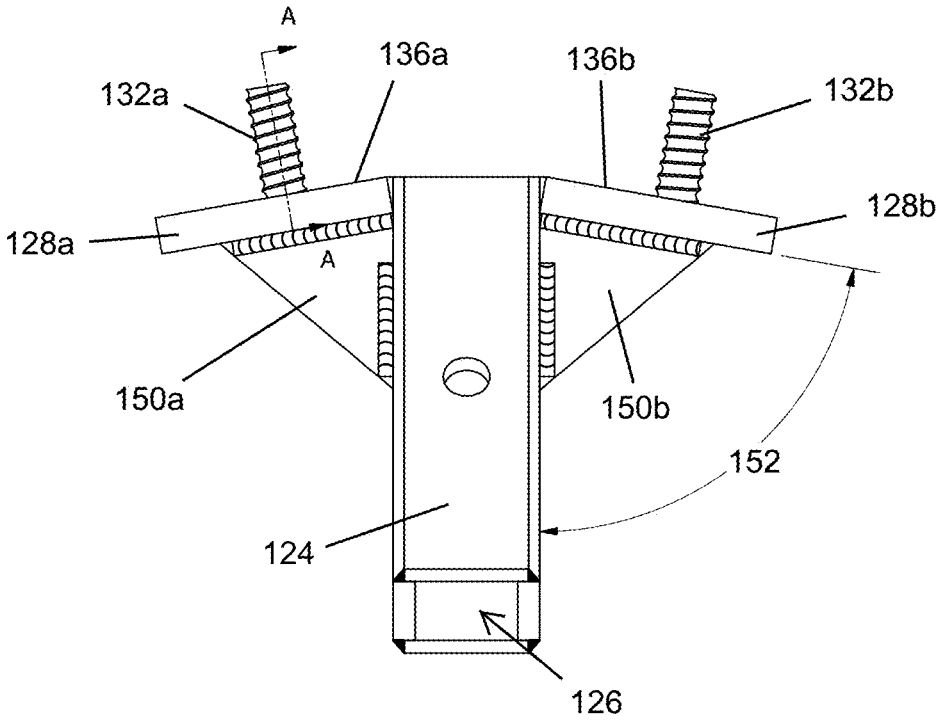
FIG. 13 is a side elevation view of the ground anchor bracket shown in FIG. 11.
Figure 13A:
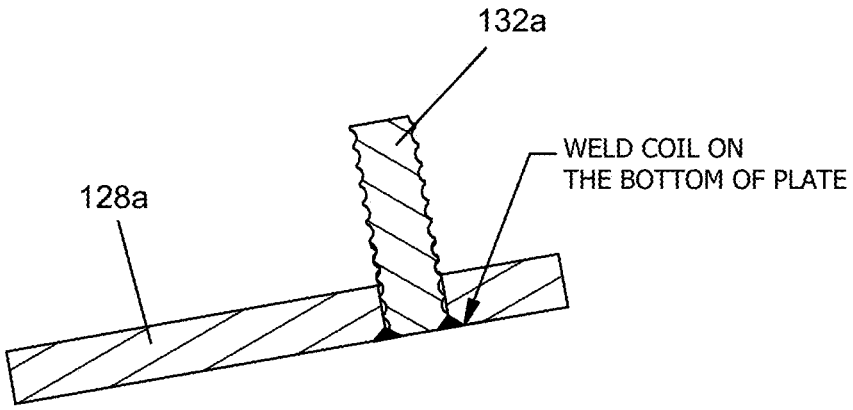
FIG. 13A is a cross-sectional view of the ground anchor bracket, taken at line A-A shown in FIG. 13.
Figure 14:
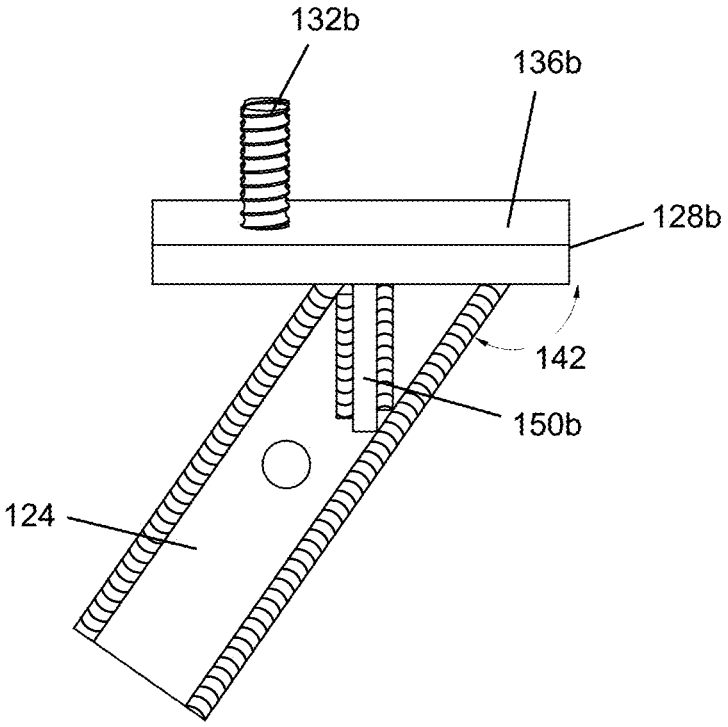
FIG. 14 is a side elevation view of the ground anchor bracket shown in FIG. 11.

Referring now to FIGS. 9-14, an additional embodiment of the ground anchor bracket 112 is provided that supports two wall braces 114*a*, 114*b* at a single ground anchor 116. The ground anchor bracket 112 has a sleeve 124 that receives a stem or upper portion of the anchor 116. The sleeve 124 has a wall structure with a generally consistent wall thickness disposed around the hollow interior area 126 of the sleeve 124, which is disposed generally centrally through the sleeve 124. Similar to the embodiment shown in FIG. 7B, the sleeve 124 shown in FIG. 14 is formed with multiple pieces or plates, where four individual plates are welded at corners 125 of the sleeve 124 to surround the hollow interior area 126 that receives the anchor stem. It is also contemplated that the sleeve used for supporting multiple wall braces may a tubular construction without welded corners or other conceivable sleeve configuration. Thus, the ground anchor bracket 112 may also have a non-circular cross sectional shape that mates with the upper portion of the helical anchor 116 to prevent rotation of the sleeve 124 on the helical anchor 116, such as the substantially square shaped cross-section shown in FIG. 11.

Figure 10:
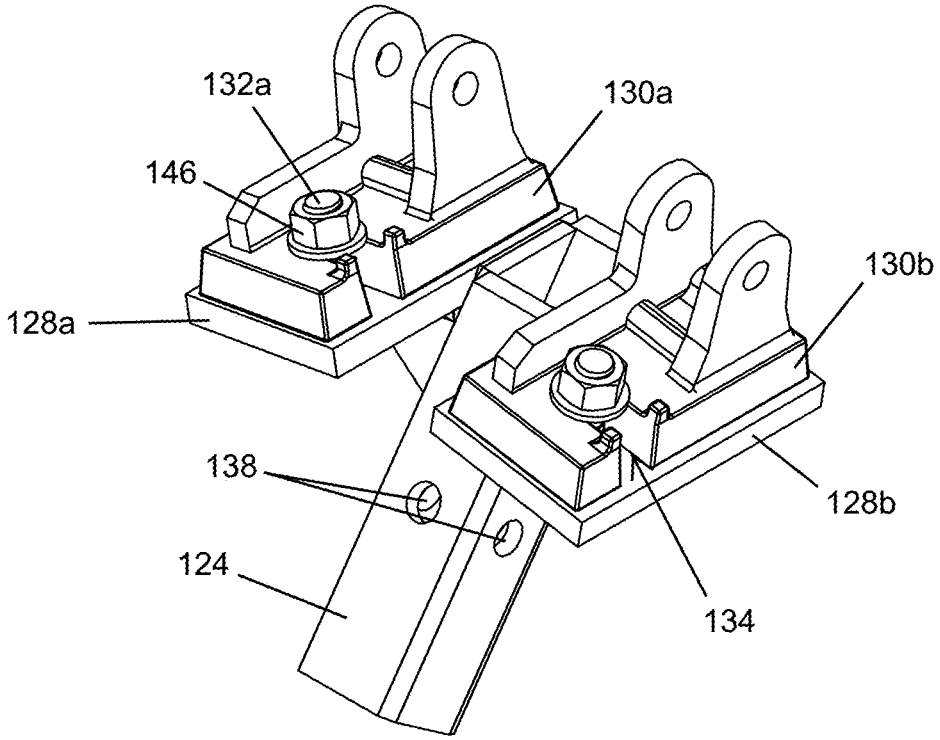
FIG. 10 is a perspective view of the ground anchor bracket shown in FIG. 9, showing the connection shoes of the braces attached to the bracket.
Figure 11:
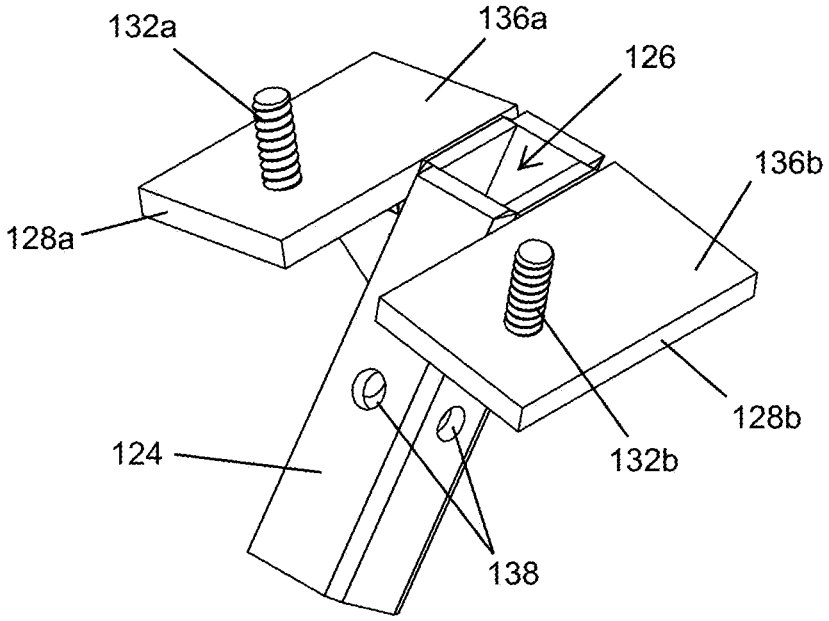
FIG. 11 is a perspective view of the ground anchor bracket shown in FIG. 10 without the connection shoes attached.
Figure 12:
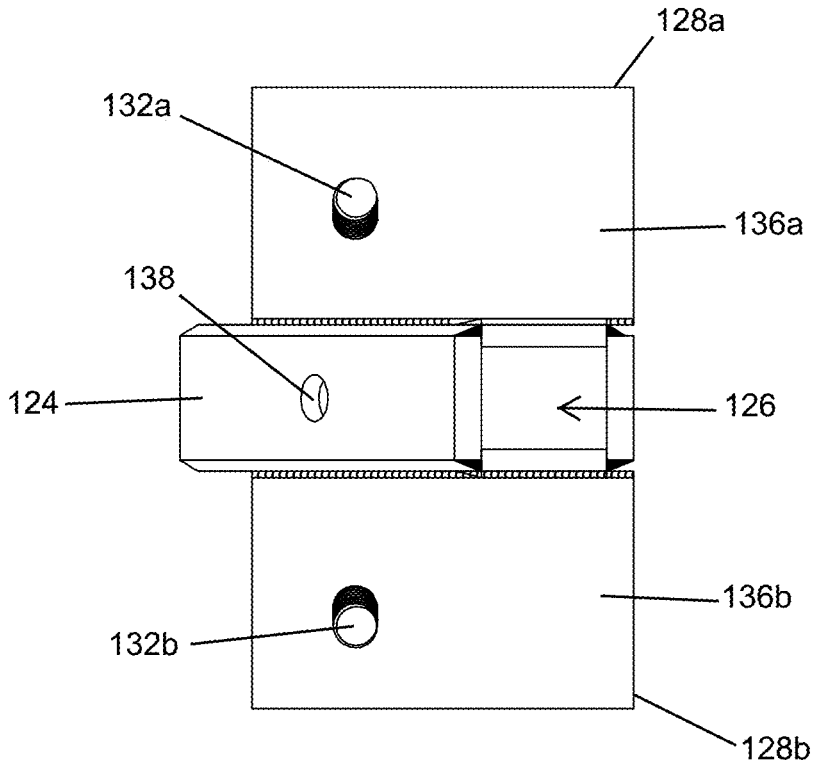
FIG. 12 is a top plan view of the ground anchor bracket shown in FIG. 11.

The ground anchor bracket 112 may have a platform to support each wall brace, such as a pair of platforms 128*a*, 128*b* attached to or supported at an upper portion of the sleeve 124 as shown in FIG. 10. Each platform 128*a*, 128*b* supports a shoe 130*a*, 130*b* that is disposed at the lower end of the respective wall brace 114*a*, 114*b*. A retention member, such as a coil or post 132*a*, 132*b*, may protrude upward from the respective platform 128*a*, 128*b* to engage a slot 134 in the respective shoe 130*a*, 130*b*, as shown in FIG. 10. Also, an upper surface 136*a*, 136*b* of each platform 128*a*, 128*b* may be substantially planar to simulate a slab floor surface for engaging a bottom surface of the shoe 130*a*. 130*b* at the respective wall brace 114*a*, 114*b*.

The platform 128*a*, 18*b* attached to or supported at an upper portion of the sleeve 124, such as shown in FIGS. 11-14, may be positioned at laterally offset locations from the center of the sleeve 124, such as shown on opposing sides of the sleeve 124. As shown in FIG. 13, a bracket 150*a*, 150*b* may be attached at an outer surface of the sleeve 124 and at a lower surface of the respective platform 128*a*, 128*b* to support the platform at a laterally offset position from the sleeve 124. The brackets 150*a*, 150*b* may also orient the upper surfaces 136*a*, 136*b* of the platforms 128*a*, 128*b* at an angle away from the sleeve to angle the wall braces 114*a*, 114*b* away from each other, such as to support separate wall panels or the like. As shown in FIG. 13, the angle 152 between the respective platform and the sleeve that provides such separation of the wall braces 114*a*, 114*b* is approximately between 45° and 80° or approximately 55°.

As also shown in FIG. 14, the upper surfaces 136*a*, 136*b* of the platform 28 may be substantially planar to simulate a slab floor surface for engaging the respective shoe 130*a*, 130*b* of the wall brace 114*a*, 114*b*. The upper surfaces 136*a*, 136*b* may thus extend substantially horizontally toward and away from the supported wall panel. Accordingly, the offset angle 142 shown in FIG. 14 may be at or between 110° and 135° or between 115° and 130° or approximately 125°. The offset angle 142 may be configured to provide the illustrated orientation of the upper surfaces 136*a*, 136*b* of the platforms

128*a*, 128*b* when the elongated shank 132 of the ground anchor 116 is angled at approximately 55° when engaged in the ground, such that the wall braces when viewed from the side may be substantially aligned with the angle of the ground anchor 116 engaged in the ground to efficiently hold and brace under load conditions.

It is to be understood that the specific devices and processes illustrated in the attached drawings, and described in this specification are simply exemplary embodiments of the inventive concepts defined in the appended claims. Hence, specific values and other precise physical characteristics relating to the embodiments disclosed herein are not to be considered as limiting, unless the claims expressly state otherwise.

Changes and modifications in the specifically described embodiments may be carried out without departing from the principles of the present disclosure, which is intended to be limited only by the scope of the appended claims as interpreted according to the principles of patent law. The disclosure has been described in an illustrative manner, and it is to be understood that the terminology which has been used is intended to be in the nature of words of description rather than of limitation. Many modifications and variations of the present disclosure are possible in light of the above teachings, and the disclosure may be practiced otherwise than as specifically described.

What is claimed is:

1. A ground anchor assembly comprising:

a wall brace having a coupling disposed at a lower end of the wall brace, the coupling having a bottom surface defining a bottom surface shape;

an earth anchor having a ground engagement portion and a stem portion, the stem portion having an orthogonal cross-section; and a ground anchor bracket comprising:

a non-circular sleeve having a wall structure engaged around an upper end of the stem portion of the earth anchor to prevent the sleeve from rotating relative to the stem portion, the wall structure surrounding a hollow interior area that defines an interior axis that aligns with a linear extent of the stem portion;

a platform having a planar shape defining a planar upper surface that interfaces with and supports the bottom surface of the coupling of the wall brace, the planar shape having a larger surface area than the bottom surface shape, the platform attached at an upper portion of the wall structure with the planar upper surface fixed at a non-perpendicular angle relative to the interior axis of the sleeve; and a post fixedly attached to a lower surface of the platform and upwardly extending through the upper surface of the platform to engage the coupling of the wall brace, the post laterally offset from an opening of the hollow interior area in the plane of the platform and disposed outside of the hollow interior area.

2. The ground anchor assembly of claim 1, wherein the wall structure of the sleeve comprises an aperture transverse to the interior axis of the sleeve and configured to receive a fastener that temporarily engages the stem portion of the earth anchor.

3. The ground anchor assembly of claim 2, wherein the upper portion of the wall structure includes an upper edge that is disposed around the wall structure in a plane that is oriented at the non-perpendicular angle from the interior axis of the sleeve.

4. The ground anchor assembly of claim 3, wherein the non-perpendicular angle is greater than 110°.

5. The ground anchor assembly of claim 3, wherein the upper edge is attached at a lower surface of the platform.

6. The ground anchor assembly of claim 5, wherein the sleeve is welded to the lower surface of the platform.

7. The ground anchor assembly of claim 1, wherein the post comprises a threaded outer surface and extends through the coupling of the wall brace.

8. The ground anchor assembly of claim 1, wherein, in the plane of the platform, the post is laterally offset from the opening of the hollow interior area, and below the plane of the platform, the hollow interior area is oriented at the non-perpendicular angle such that the hollow interior area is positioned below the post in at least one location.

9. The ground anchor assembly of claim 7, wherein the ground anchor bracket further comprises a nut that threadeably engages the post and secures the coupling of the wall brace against the planar upper surface of the platform.

10. The ground anchor assembly of claim 1, wherein the wall structure of the sleeve comprises a cross-sectional shape that corresponds with a cross-sectional shape of the stem portion of the earth anchor.

11. The ground anchor assembly of claim 10, wherein the wall structure of the sleeve comprises four plates welded together at edges thereof to form corners of the cross-sectional shape of the wall structure.

12. A ground anchor assembly comprising:

a wall brace having a coupling disposed at a lower end of the wall brace;

a helical ground anchor having an orthogonal stem portion; and a ground anchor bracket comprising:

a non-circular sleeve having a wall structure defining a tubular shape that is engaged around an upper end of the stem portion of the helical ground anchor so as to prevent the sleeve from rotating about the stem portion, the wall structure of the sleeve surrounding a hollow interior area that defines a central axis; and a platform having a plate defining a planar upper surface that receives the coupling of the wall brace and a lower surface is attached at an upper edge of the wall structure with the planar upper surface fixed at a non-perpendicular angle relative to the central axis of the sleeve; and a threaded post welded to a lower surface of the platform and upwardly extending from the upper surface of the plate to engage the coupling, wherein the threaded post is laterally offset from and does not enter an opening of the hollow interior area.

13. The ground anchor assembly of claim 12, wherein the threaded post extends through the coupling of the wall brace to temporarily engage the coupling to the platform.

14. The ground anchor assembly of claim 13, wherein the planar bottom surface of the coupling defines a bottom surface shape and wherein the upper surface of the platform defines an upper surface shape, the upper surface shape being larger than the bottom surface shape.

15. The ground anchor assembly of claim 14, wherein the ground anchor bracket further comprises a nut that threadeably engages the threaded post and secures the coupling of the wall brace against the planar upper surface of the platform.

16. The ground anchor assembly of claim 12, wherein the sleeve is welded to the lower surface of the platform.

17. The ground anchor assembly of claim 12, wherein the wall structure of the sleeve comprises four plates welded together at edges thereof to form corners of the wall structure.

18. A ground anchor assembly comprising:

a wall brace having an upper shoe disposed at a top end of the wall brace for engaging a wall and a lower shoe disposed at a bottom end of the wall brace;

an earth anchor having a ground engaging portion for engaging in the ground and a stem portion protruding from the ground engaging portion, the stem portion having an orthogonal cross-section; and a ground anchor bracket comprising:

a sleeve having a wall structure engaged around an upper end of the stem portion of the earth anchor, the wall structure surrounding a hollow interior area that defines a linear central axis that aligns with the stem portion, and the wall structure including an upper edge that is disposed around the wall structure in a plane that is oriented at an offset angle from the linear central axis of the sleeve, and the sleeve including a non-circular cross-section for preventing rotation around the stem portion;

a platform having an upper surface that engages with and supports a bottom surface of the lower shoe of the wall brace, the upper surface being larger than the bottom surface, the platform fixedly attached at the upper edge of the wall structure with the upper surface disposed at the offset angle relative to the linear central axis of the sleeve; and a post affixed to a lower surface of the platform and upwardly extending from through the upper surface, opposite the upper edge, the post laterally offset from an opening of the hollow interior area and engaged between the lower shoe of the wall brace and the platform of the ground anchor bracket.

19. The ground anchor assembly of claim 18, wherein the wall structure of the sleeve comprises an aperture transverse to the linear central axis of the sleeve and configured to receive a fastener that temporarily engages the stem portion of the earth anchor.

20. The ground anchor assembly of claim 18, wherein the post comprises a threaded outer surface that extends through the lower shoe of the wall brace, the ground anchor bracket further comprising a nut that threadably engages the post and secures the coupling to the platform.

* * * * *